US011268784B1

(12) United States Patent
Lee et al.

(10) Patent No.: US 11,268,784 B1
(45) **Date of Patent: *Mar. 8, 2022**

(54) BI-DIRECTIONAL FOLDABLE FIREARM STOCK

(71) Applicants: Shanyao Lee, Santa Ana, CA (US); Chien-Yuan Cheng, New Taipei (TW)

(72) Inventors: Shanyao Lee, Santa Ana, CA (US); Chien-Yuan Cheng, New Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 17/193,273

(22) Filed: Mar. 5, 2021

(51) Int. Cl.
*F41C 23/04* (2006.01)

(52) U.S. Cl.
CPC ..... *F41C 23/04* (2013.01)

(58) Field of Classification Search
CPC ..... F41C 23/04; F41C 23/14; F41C 27/06; F41A 3/84; F41A 11/02; F41A 3/66; F41A 11/04; F41A 19/10; F41A 3/26; F41A 35/06
USPC ..... 42/73, 1.06, 71.01, 72, 74, 71.02, 42/75.01–75.1; 89/191.01, 193, 198
See application file for complete search history.

(56) References Cited

U.S. PATENT DOCUMENTS 4,513,523 A * 4/1985 Gal ..... F41C 23/04 42/72
4,640,036 A * 2/1987 Gal ..... F41C 23/04 42/72
4,735,007 A * 4/1988 Gal ..... F41C 23/04 42/7
4,766,800 A * 8/1988 Miller ..... F41A 17/38 89/33.02
2009/0288324 A1* 11/2009 Peterson ..... F41A 11/02 42/75.03
2011/0131857 A1* 6/2011 Kuczynko ..... F41C 23/04 42/73
2012/0137562 A1* 6/2012 Langevin ..... F41C 23/14 42/75.03
2014/0026745 A1* 1/2014 Lee ..... F41A 3/86 89/198
2014/0075815 A1* 3/2014 Jarboe ..... F41C 23/14 42/73
2014/0331539 A1* 11/2014 Malik ..... F41C 23/04 42/73
2016/0202016 A1* 7/2016 Mather ..... F41C 23/14 42/73
2017/0356712 A1* 12/2017 Johnson ..... F41C 7/11
2018/0195822 A1* 7/2018 Jonsson ..... F41A 3/66
2020/0200505 A1* 6/2020 Brown, Jr. ..... F41C 23/14
2021/0215451 A1* 7/2021 Ding ..... F41C 23/14
2021/0222993 A1* 7/2021 Morenz ..... F41C 23/04

* cited by examiner

*Primary Examiner* — Michael D David
(74) *Attorney, Agent, or Firm* — Che-Yang Chen; Law Office of Michael Chen

(57) ABSTRACT

In one aspect, a bi-directional foldable stock for a firearm may include a stock-to-firearm adaptor configured to be an interface to connect the firearm and the stock. The adaptor may include a base and a movable top portion that is pivotally and detachably engaged with the base. The top portion is attached to the firearm while the base is connected to the stock. The base with the stock is configured to pivotally rotate either in a clockwise or counter-clockwise manner to fold the stock on either sides of the firearm.

11 Claims, 14 Drawing Sheets

BI-DIRECTIONAL FOLDABLE FIREARM STOCK

FIELD OF THE INVENTION

The present invention relates to a firearm stock, and more particularly relates to a bi-directional foldable firearm stock that is easy for the user to operate.

BACKGROUND OF THE INVENTION

Since the advent of shoulder-fired weaponry, such as guns, the use of a stock for holding the barrel and firing mechanisms of the weapon has been a standard practice. Typically, a stock made of wood, plastic, or metal extended rearward from the firing mechanism some finite distance creating the "gun butt" or "butt stock" portion. This butt stock portion was used to stabilize the weapon. The user would press the butt stock into his or her shoulder while taking aim and firing the weapon.

In recent firearm design, a folding stock assembly has played an important role. The folding stock assembly in many designs requires the user translate the folding stock along an axis prior to and/or during rotation about that axis (e.g., a vertical axis). Requiring the user translate the stock on the axis reduces the reliability of the weapon itself and increases the complexity of use of the weapon.

In another example, a folding stock generally has a folded configuration and an unfolded configuration, with the same locking mechanism being used to selectively maintain the stock assembly in the folded and unfolded configurations. Using the same lock for maintaining both configurations limits the freedom of the designer to control folding and unfolding forces.

U.S. Pat. No. 10,156,421 to Smith et al. discloses a stock for a firearm, which is configured for bi-directional folding to either side of a receiver of the firearm. However, when the stock changes from one folded configuration to another folded configuration, the user has to manually switch the mounting pins to change one folded configuration to another, which is inconvenient to the user, reduces the reliability of the firearm itself, and increases the complexity to operate the firearm. Therefore, there remains a need for a new and improved bi-direction foldable firearm stock to overcome the problems stated above.

SUMMARY OF THE INVENTION

In one aspect, a stock-to-firearm adaptor may include a base and a movable top portion that is pivotally and detachably engaged with the base. In one embodiment, the top portion may include a first button and a second button that are resiliently formed and connected to one side of the top portion and configured to control a first engaging unit and a second engaging unit respectively. Each of the first button and second button can be pressed toward inside to a predetermined position and can restore to its original position through a resilient force when it is released. For example, when the first button is pressed, the top portion disengages from the base and can be lifted from a first side of the adaptor, while the adaptor is still pivotally connected with the base on a second side, so the top portion can be lifted and rotated through the pivotal connection on the second side. Likewise, when the second button is pressed, the top portion can also disengage from the base and can be lifted from the second side of the adaptor and rotated through the pivotal connection on the first side.

The top portion on the first side may include a first opening that is configured to receive a top protruding portion of the base. In one embodiment, the first engaging unit is formed and resiliently connected to one side of the top protruding portion of the base, and the first engaging unit has a resilient end and a fixed end. A pair of first side grooves are formed on each side of an inner sidewall of the top portion on the first side. Each of the first side grooves is configured to receive and secure the resilient end and fixed end of the first engaging unit respectively when the top portion engages with the base in a fully closed configuration of the stock-to-firearm adaptor.

More specifically, when the adapter is in a fully closed configuration, the first button is configured to communicatively contact with the resilient end of the first engaging unit, and when the first button is pressed, the resilient end of the first engaging unit is also pressed to retract and can be disengaged from one of the first side grooves. Meanwhile, the top portion can be simultaneously lifted to disengage the first engaging unit from the other first side groove, so the entire top portion can be lifted away from the base on the first side, and rotates at most 180 degrees through the pivotal connection on the second side.

It is noted that the base may further include a position securing unit which is resiliently connected to an inner sidewall of the base and located between the inner sidewall of the base and the corresponding side of an inner sidewall of the top portion. More specifically, when the top portion is engaged with the base, the position securing unit is completely pressed into the inner sidewall of the base to form a portion of the inner sidewall of the base, which is between the base and the corresponding side of the inner sidewall of the top portion. For example, when the top portion is lifted and extends by rotating away from the first side, a portion of the position securing unit pops out from the inner sidewall of the base because of the resilient force, while the other portion thereof is still being pressed by the inner sidewall of the top portion.

As the top portion continues to pivotally rotate away from the first side, more portions of the position securing unit pop out. The top portion can rotate at most 180 degrees away from the first side and is fully extended. More importantly, the position securing unit fully pops out at this time and is blocked by an outer edge of the top portion, so the top portion can no longer be moved. Namely, when the top portion is fully extended away from the first side, the position securing unit is blocked by the outer edge of the top portion, and acts as a lock to secure the fully extended position of the top portion.

Likewise, the top portion on the second side may include a second opening that is configured to receive the top protruding portion of the base. In one embodiment, a second engaging unit is formed and resiliently connected to the other side of the top protruding portion of the base, and the second engaging unit has a resilient end and a fixed end. A pair of second side grooves are formed on each side of an inner sidewall of the top portion on the second side. Each of the second side grooves is configured to receive and secure the resilient end and fixed end of the second engaging unit respectively when the top portion engages with the base in a fully closed configuration of the stock-to-firearm adaptor.

More specifically, when the adapter is in a fully closed configuration, the second button is configured to communicatively contact with the resilient end of the second engaging unit, and when the second button is pressed, the resilient end of the second engaging unit is also pressed to retract and can be disengaged from one of the second side grooves.

Meanwhile, the top portion can simultaneously lifted to disengage the fixed end of the second engaging unit from the other second side groove, so the entire top portion can be lifted away from the base on the second side, and rotates at most 180 degrees through the pivotal connection on the second side.

Likewise, the position securing unit stated above is resiliently connected to one side of the inner sidewall of the base, and located between the inner sidewall of the base and the corresponding side of the inner sidewall of the top portion. More specifically, when the top portion is engaged with the base, the position securing unit is completely pressed into the inner sidewall of the base to form a portion of the inner sidewall of the base, which is between the base and the corresponding side of the inner sidewall of the top portion. Similarly, when the top portion is lifted and extends by rotating away from the second side, a portion of the position securing unit pops out from the inner sidewall of the base because of the resilient force, while the other portion thereof is still being pressed by the inner sidewall of the top portion. As the top portion continues to pivotally rotate away from the second side, more portions of the position securing unit pop out.

The top portion can rotate at most 180 degrees away from the second side and is fully extended. More importantly, the position securing unit fully pops out at this time and is blocked by the outer edge of the top portion, so the top portion can no longer be moved. Namely, when the top portion is fully extended away from the second side, the position securing unit is blocked by the outer edge of the top portion, and acts as a lock to secure the fully extended position of the top portion.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

As used in the description herein and throughout the claims that follow, the meaning of "a", "an", and "the" includes reference to the plural unless the context clearly dictates otherwise. Also, as used in the description herein and throughout the claims that follow, the terms "comprise or comprising", "include or including", "have or having", "contain or containing" and the like are to be understood to be open-ended, i.e., to mean including but not limited to. As used in the description herein and throughout the claims that follow, the meaning of "in" includes "in" and "on" unless the context clearly dictates otherwise.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the embodiments. As used herein, the term "and/or" includes any and all combinations of one or more of the associated listed items.

Figure 3:
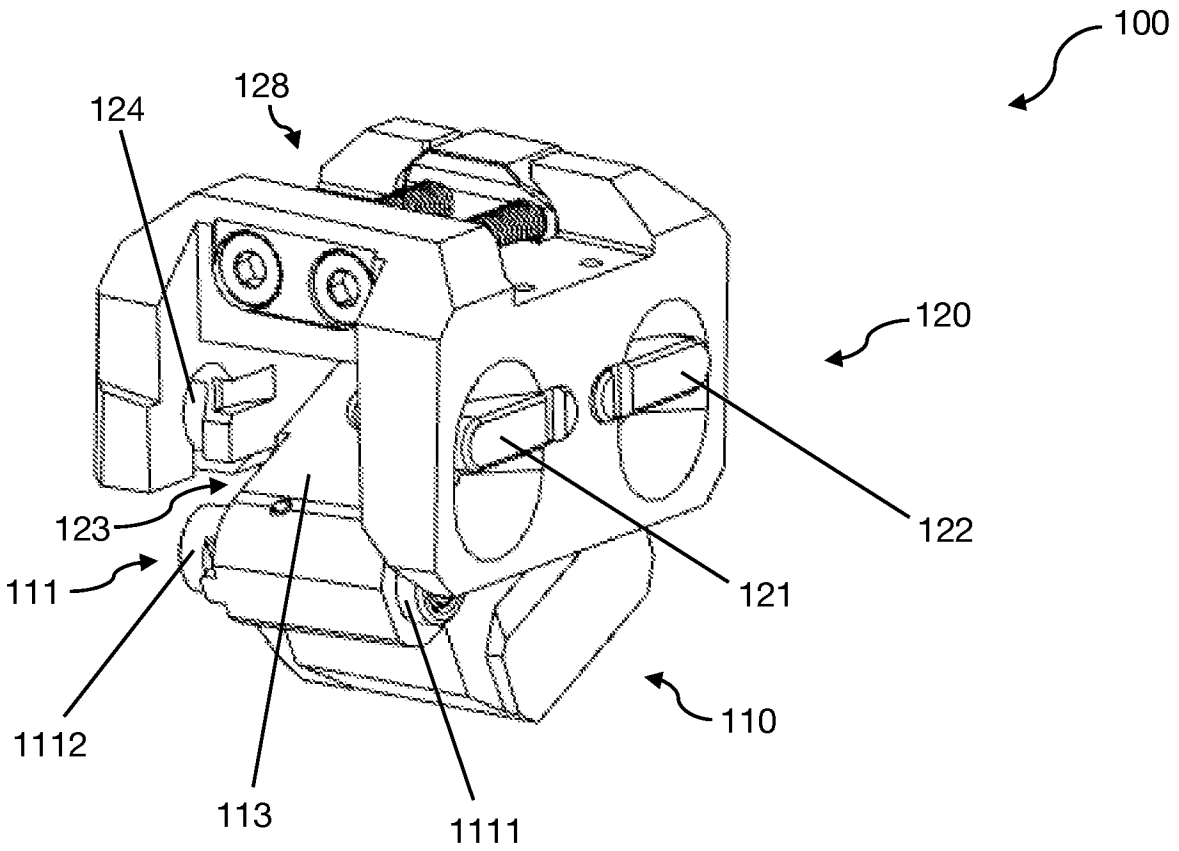
FIG. 3 is a schematic view of the stock-to-firearm adaptor when the top portion is lifted away from the first side in the present invention.
Figure 4:
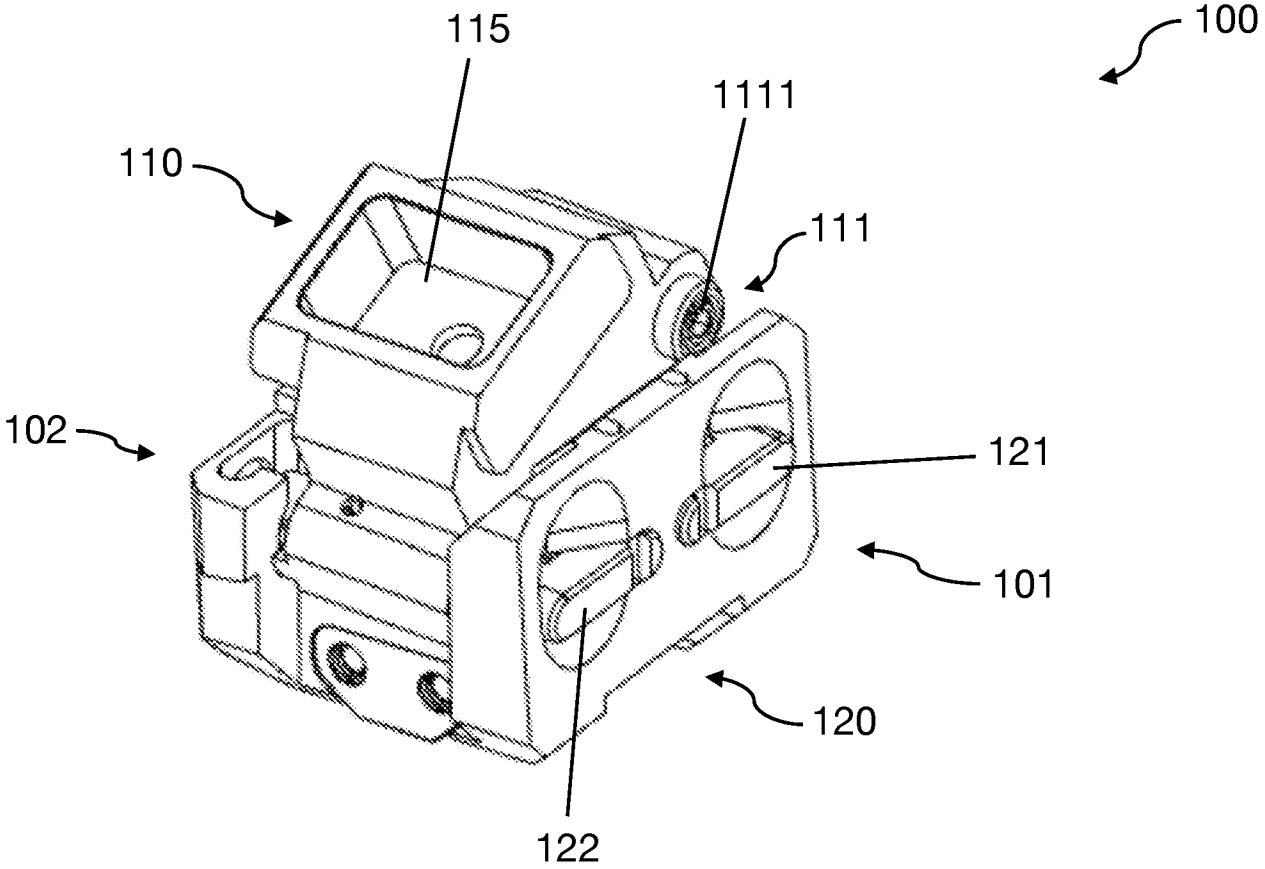
FIG. 4 is a schematic view of the stock-to-firearm adaptor when the top portion is lifted away from the first side from the view angle in FIG. 2 in the present invention.
Figure 9:
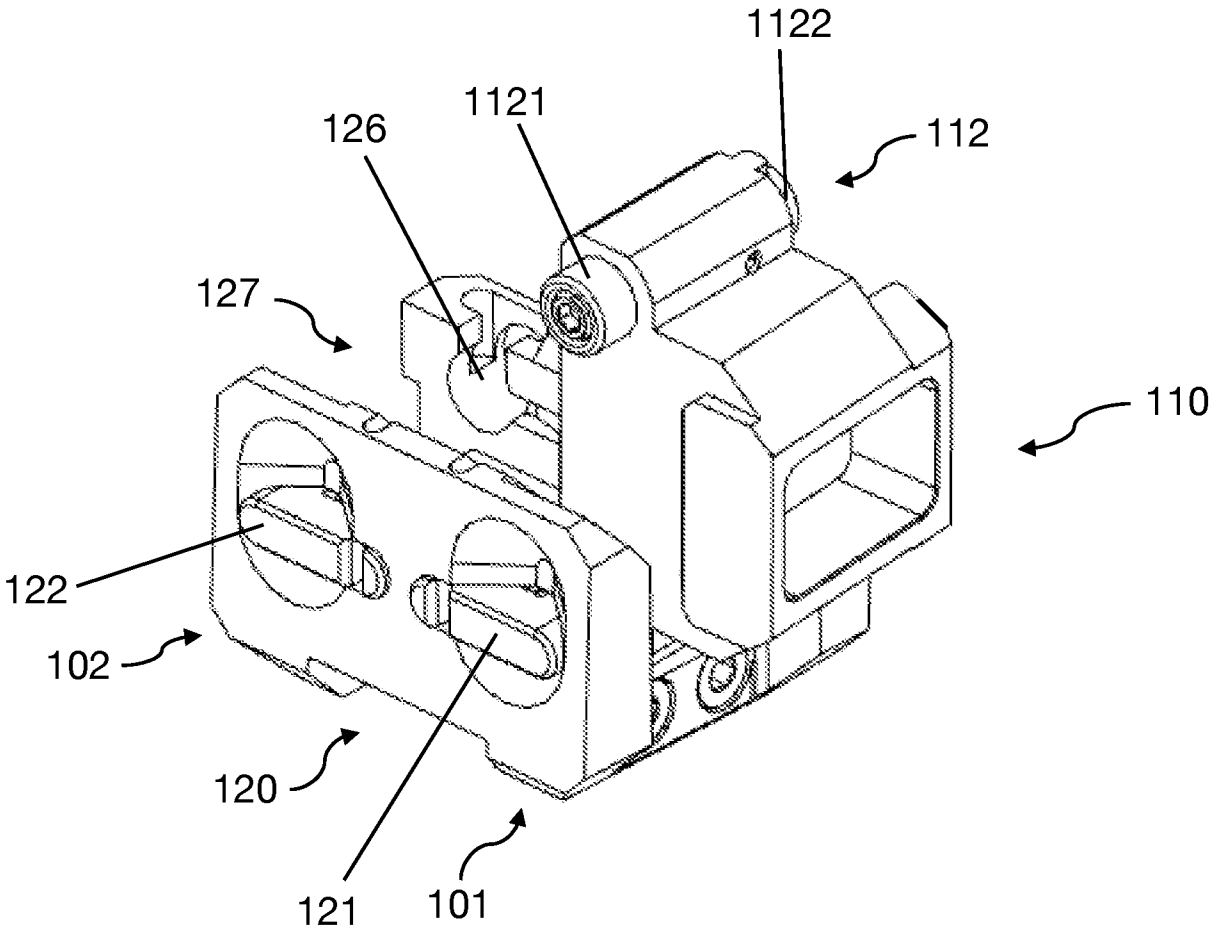
FIG. 9 is a schematic view of the stock-to-firearm adaptor when the top portion is lifted away from the second side in the present invention.
Figure 10:
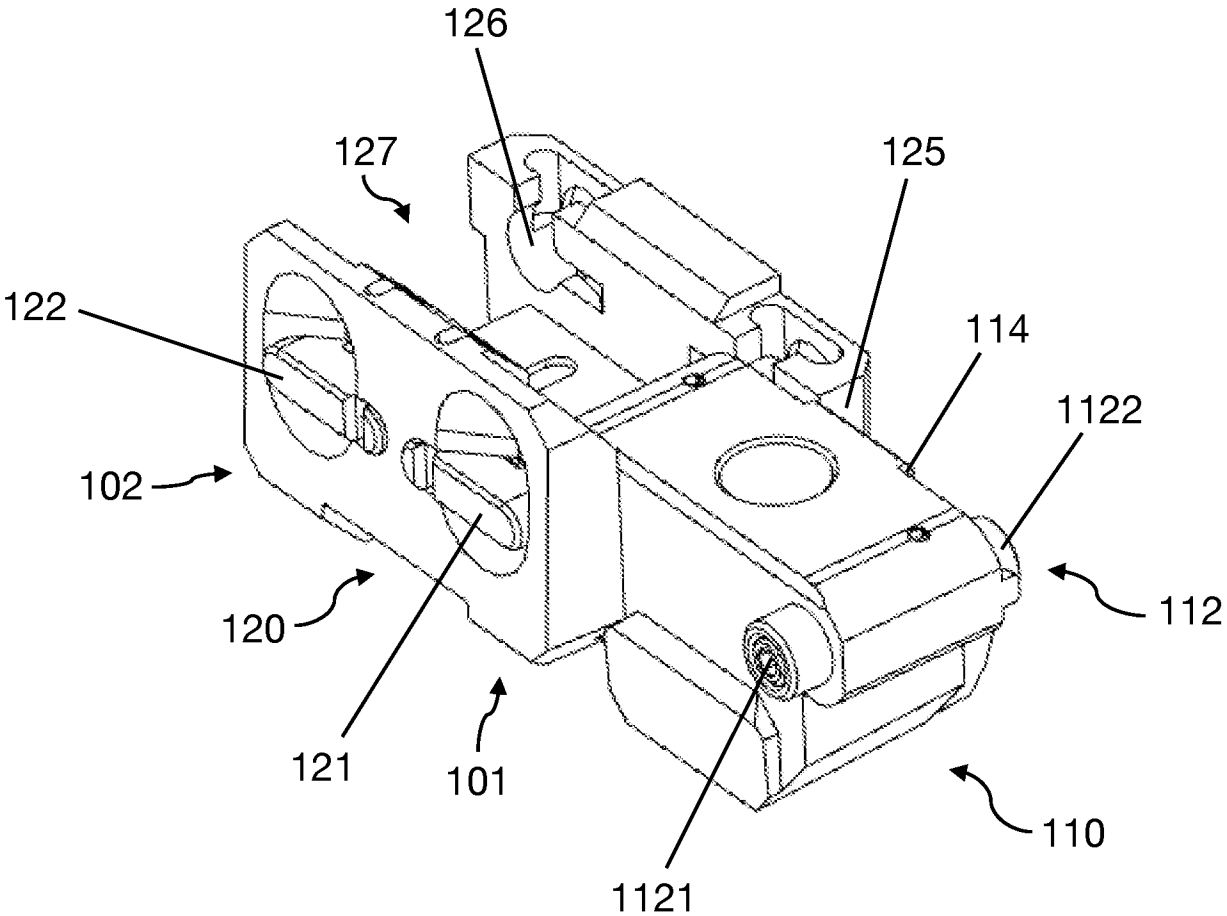
FIG. 10 is a schematic view of the stock-to-firearm adaptor when the top portion is fully extended in the present invention.

In one aspect, referring to FIGS. 1 to 5, a stock-to-firearm adaptor 100 may include a base 110 and a movable top portion 120 that is pivotally and detachably engaged with the base 110. In one embodiment, the top portion 120 may include a first button 121 and a second button 122 that are resiliently formed and connected to one side of the top portion 120 and configured to control a first engaging unit 111 and a second engaging unit 112 respectively. Each of the first button 121 and second button 122 can be pressed toward inside to a predetermined position and can restore to its original position through a resilient force when it is released. For example, when the first button 121 is pressed as shown in FIGS. 3 and 4, the top portion 120 disengages from the base 110 and can be lifted from a first side 101 of the adaptor 100, while the adaptor 100 is still pivotally connected with the base 110 on a second side 102, so the top portion 120 can be lifted and rotated through the pivotal connection on the second side 102. Likewise, when the second button 122 is pressed, the top portion 120 can also disengage from the base 110 and can be lifted from the second side 102 of the adaptor 100 and rotated through the pivotal connection on the first side 101 as shown in FIGS. 9 and 10.

Figure 5:
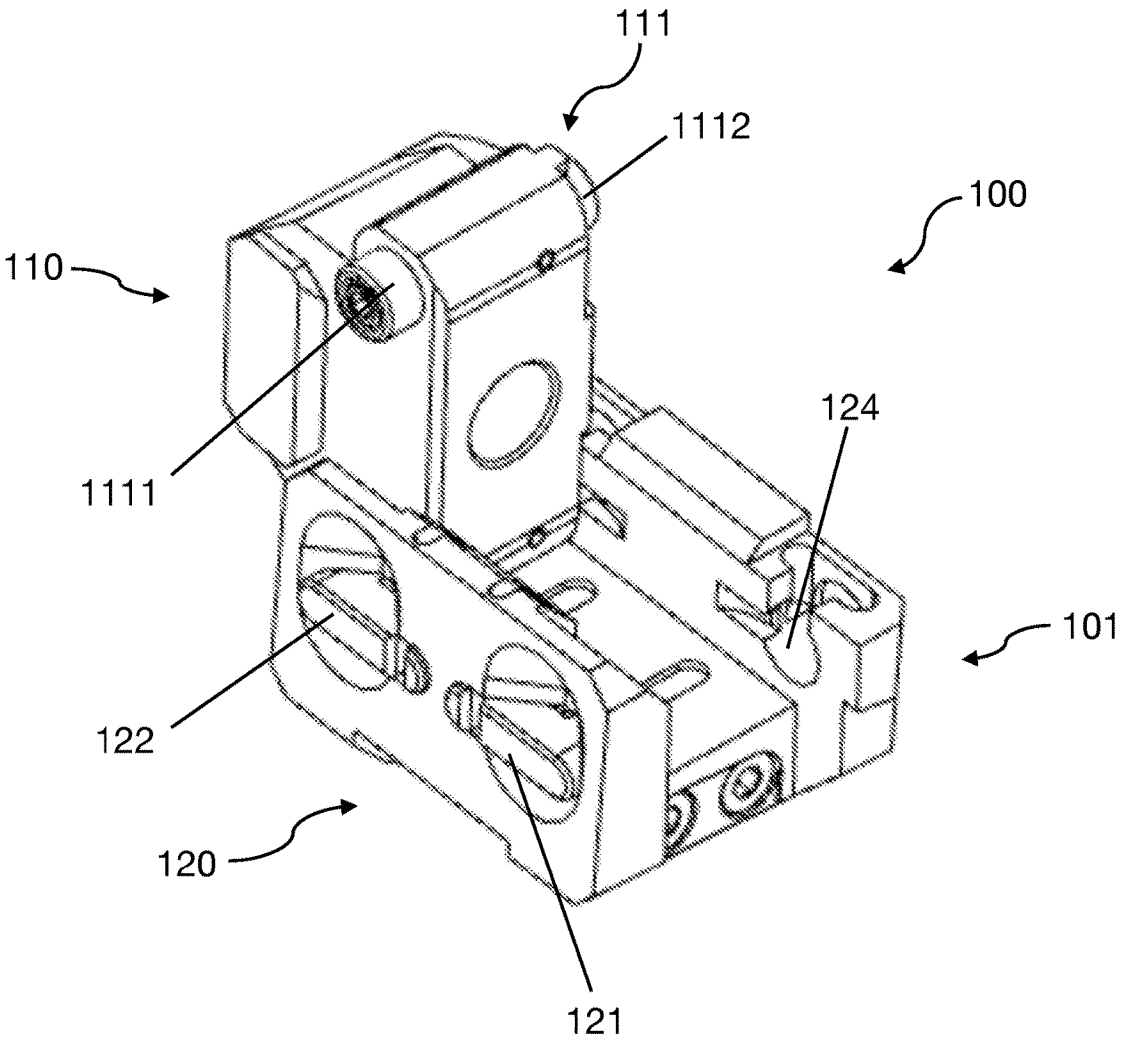
FIG. 5 is a schematic view of the stock-to-firearm adaptor when the top portion is lifted away from the first side and rotated toward the fully extended position in the present invention.

As shown in FIGS. 3 to 5, the top portion 120 on the first side 101 may include a first opening 123 that is configured to receive a top protruding portion 113 of the base 110. In one embodiment, the first engaging unit 111 is formed and resiliently connected to one side of the top protruding portion 113 of the base 110, and the first engaging unit 111 has a resilient end 1111 and a fixed end 1112. A pair of first side grooves 124 are formed on each side of an inner sidewall of the top portion 120 on the first side 101. Each of the first side grooves 124 is configured to receive and secure the resilient end 1111 and fixed end 1112 of the first engaging unit 111 respectively when the top portion 120 engages with the base 110 in a fully closed configuration of the stock-to-firearm adaptor 100.

More specifically, when the adapter 100 is in a fully closed configuration, the first button 121 is configured to communicatively contact with the resilient end 1111 of the first engaging unit 111, and when the first button 111 is pressed, the resilient end 1111 of the first engaging unit 111 is also pressed to retract and can be disengaged from one of the first side grooves 124. Meanwhile, the top portion 120 can be simultaneously lifted to disengage the fixed end 1112 of the first engaging unit 111 from the other first side groove 124, so the entire top portion 120 can be lifted away from the base 110 on the first side 101, and rotates at most 180 degrees through the pivotal connection between the top portion 120 and the base 110 on the second side 102 as shown in FIGS. 3 to 8.

Figure 6:
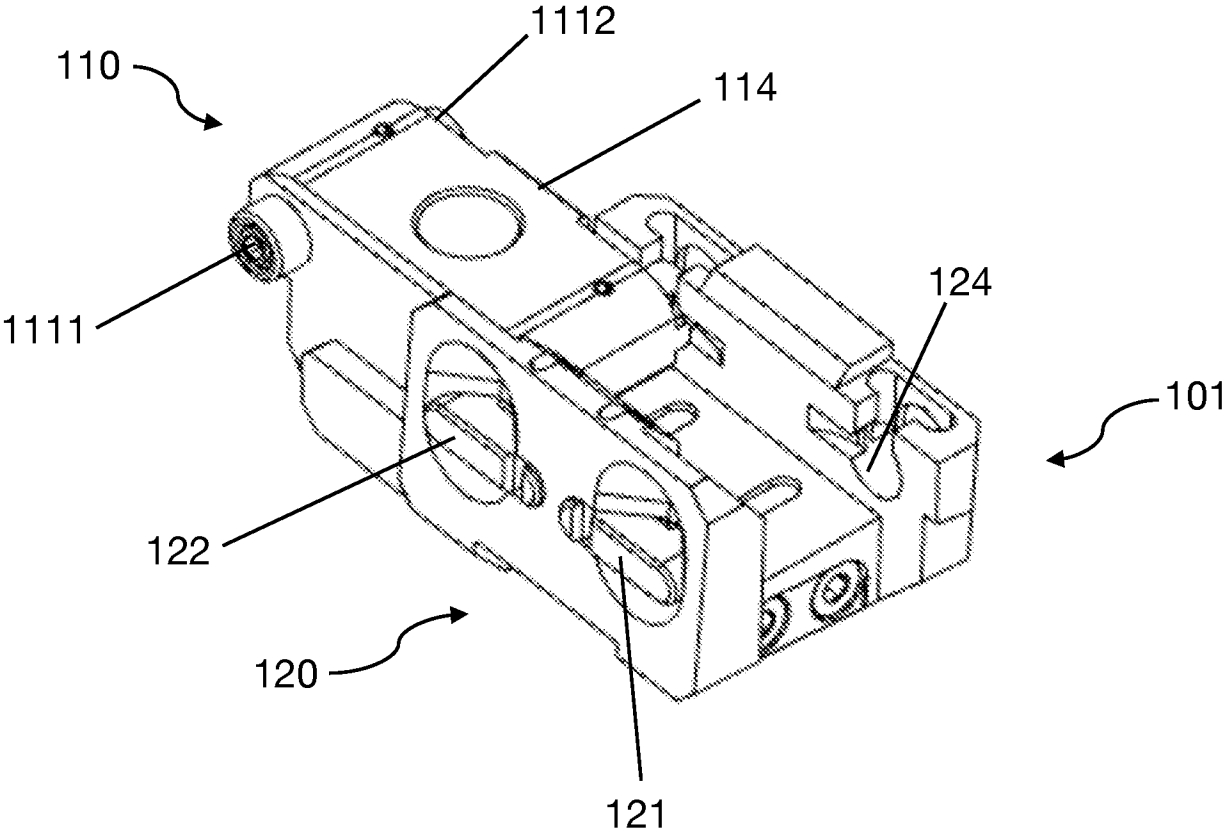
FIG. 6 illustrates a schematic view of the stock-to-firearm adaptor when the top portion is fully extended in the present invention.
Figure 7:
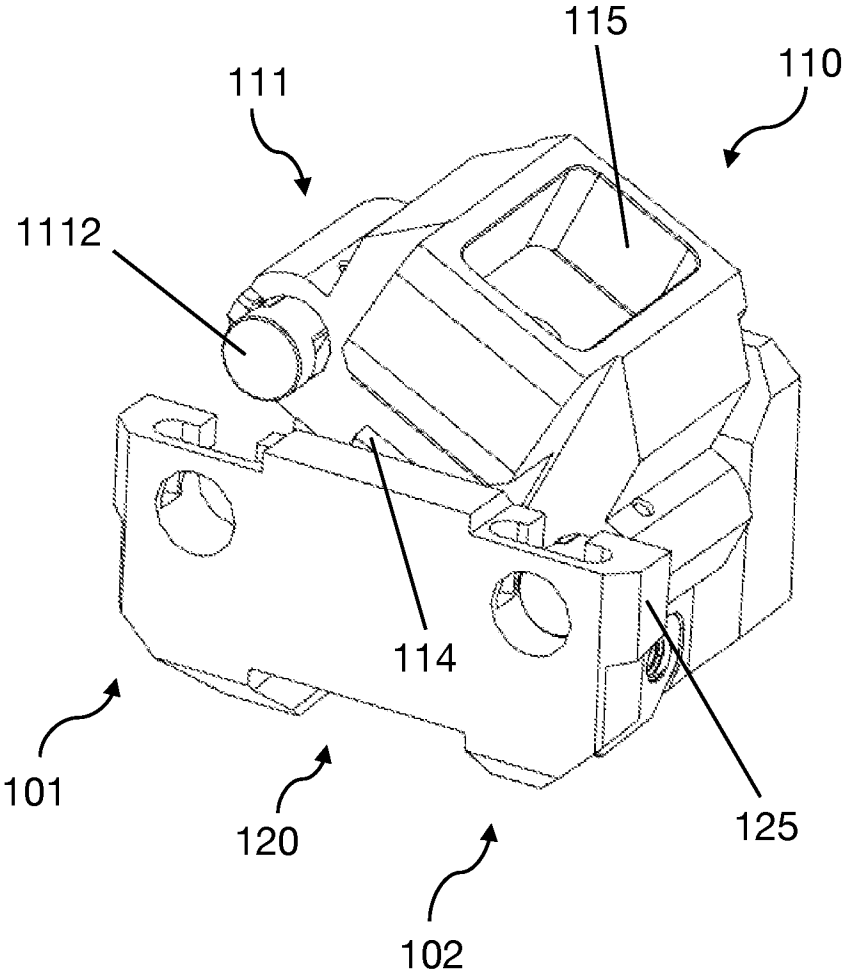
FIG. 7 is a schematic view of the stock-to-firearm adaptor when the top portion is lifted away from the first side and rotated toward the fully extended position from another view angle to show the securing unit in the present invention.
Figure 8:
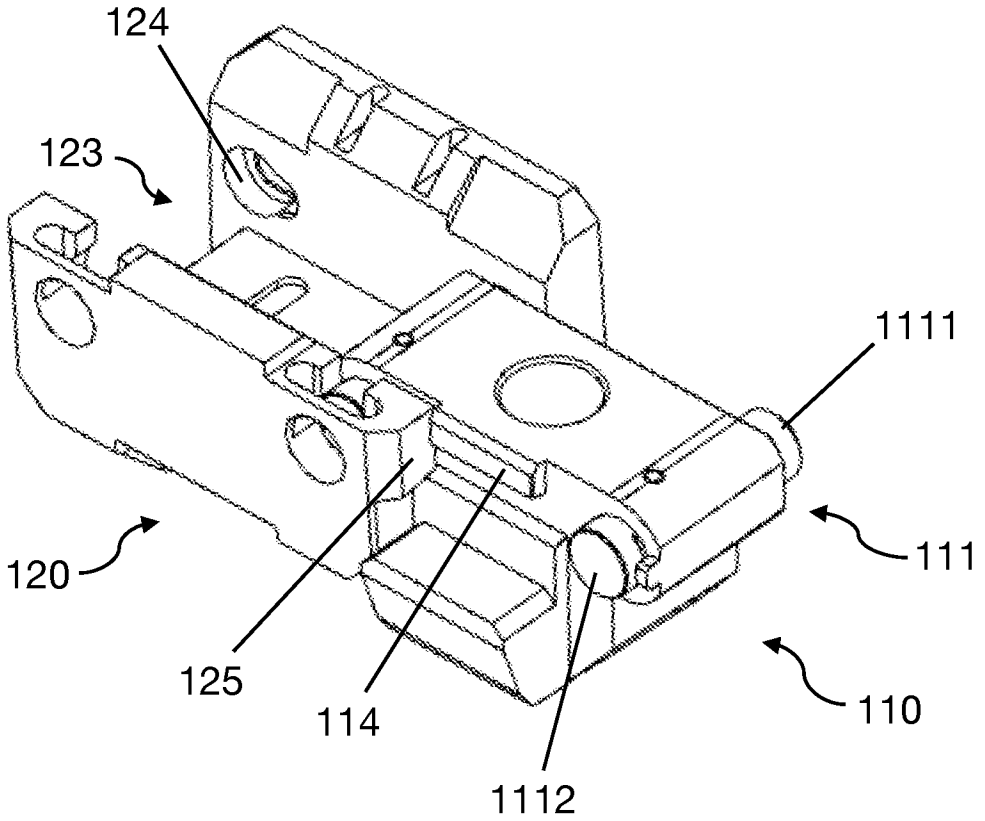
FIG. 8 is a schematic view of the stock-to-firearm adaptor when the top portion is lifted away from the first side and rotated toward the fully extended position from another view angle to show the securing unit blocked by the outer edge of the top portion to secure the fully extended position of the top portion.

It is noted that the base 110 may further include a position securing unit 114 which is resiliently connected to an inner sidewall of the base 110 and located between the inner sidewall of the base 110 and the corresponding side of an inner sidewall of the top portion 120 as shown in FIGS. 6 to 8. More specifically, when the top portion 120 is engaged with the base 110, the position securing unit 114 is completely pressed into the inner sidewall of the base 110 to form a portion of the inner sidewall of the base 110, which is between the base 110 and the corresponding side of the inner sidewall of the top portion 120. As shown in FIG. 7, for example, when the top portion 120 is lifted and extends by rotating away from the first side 101, a portion of the position securing unit 114 pops out from the inner sidewall of the base 110 because of the resilient force, while the other portion thereof is still being pressed by the inner sidewall of the top portion 120.

As can be seen in FIGS. 7 and 8, as the top portion 120 continues to pivotally rotate away from the first side 101, more portions of the position securing unit 114 pop out. In one embodiment, as shown in FIGS. 6 and 8, the top portion 120 can rotate at most 180 degrees away from the first side 101 and is fully extended. More importantly, the position securing unit 114 fully pops out at this time and is blocked by an outer edge 125 of the top portion 120, so the top portion 120 can no longer be moved, and the base 110 and the top portion 120 are secured in a linear configuration. Namely, when the top portion 120 is fully extended away from the first side 101, the position securing unit 114 is blocked by the outer edge 125 of the top portion 120, and acts as a lock to secure the fully extended position of the top portion 120. It is noted that the position securing unit 114 and the outer edge 125 can be designed to accommodate any possible angle between the top portion and the base 110.

Likewise, as shown in FIGS. 9 and 10, the top portion 120 on the second side 102 may include a second opening 127 that is configured to receive the top protruding portion 113 of the base 110. In one embodiment, a second engaging unit 112 is formed and resiliently connected to the other side of the top protruding portion 113 of the base 110, and the second engaging unit 112 has a resilient end 1121 and a fixed end 1122. A pair of second side grooves 126 are formed on each side of an inner sidewall of the top portion 120 on the second side 102. Each of the second side grooves 126 is configured to receive and secure the resilient end 1121 and fixed end 1122 of the second engaging unit 112 respectively when the top portion 120 engages with the base 110 in a fully closed configuration of the stock-to-firearm adaptor 100.

More specifically, when the adapter 100 is in a fully closed configuration, the second button 122 is configured to communicatively contact with the resilient end 1121 of the second engaging unit 112, and when the second button 122 is pressed, the resilient end 1121 of the second engaging unit 112 is also pressed to retract and can be disengaged from one of the second side grooves 126. Meanwhile, the top portion 120 can simultaneously lifted to disengage the fixed end 1122 of the second engaging unit 112 from the other second side groove 126, so the entire top portion 120 can be lifted away from the base 110 on the second side 102, and rotates at most 180 degrees through the pivotal connection on the second side 101 as shown in FIGS. 9 and 10.

Likewise, the position securing unit 114 stated above is resiliently connected to one side of the inner sidewall of the base 110, and located between the inner sidewall of the base 110 and the corresponding side of the inner sidewall of the top portion 120. More specifically, when the top portion 120 is engaged with the base 110, the position securing unit 114 is completely pressed into the inner sidewall of the base 110 to form a portion of the inner sidewall of the base 110, which is between the base 110 and the corresponding side of the inner sidewall of the top portion 120. Similarly to FIG. 7, when the top portion 120 is lifted and extends by rotating away from the second side 102, a portion of the position securing unit 114 pops out from the inner sidewall of the base 110 because of the resilient force, while the other portion thereof is still being pressed by the inner sidewall of the top portion 120. As the top portion 120 continues to pivotally rotate away from the second side 102, more portions of the position securing unit 114 pop out.

In one embodiment, as shown in FIGS. 9 and 10, the top portion 120 can rotate at most 180 degrees away from the second side 102 and is fully extended. More importantly, the position securing unit 114 fully pops out at this time and is blocked by the outer edge 125 of the top portion 120, so the top portion 120 can no longer be moved, and the base 110 and the top portion 120 are secured in a linear configuration.

Namely, when the top portion 120 is fully extended away from the second side 102, the position securing unit 114 is blocked by the outer edge 125 of the top portion 120, and acts as a lock to secure the fully extended position of the top portion 120. It is noted that the position securing unit 114 and the outer edge 125 can be designed to accommodate any possible angle between the top portion and the base 110.

Figure 1:
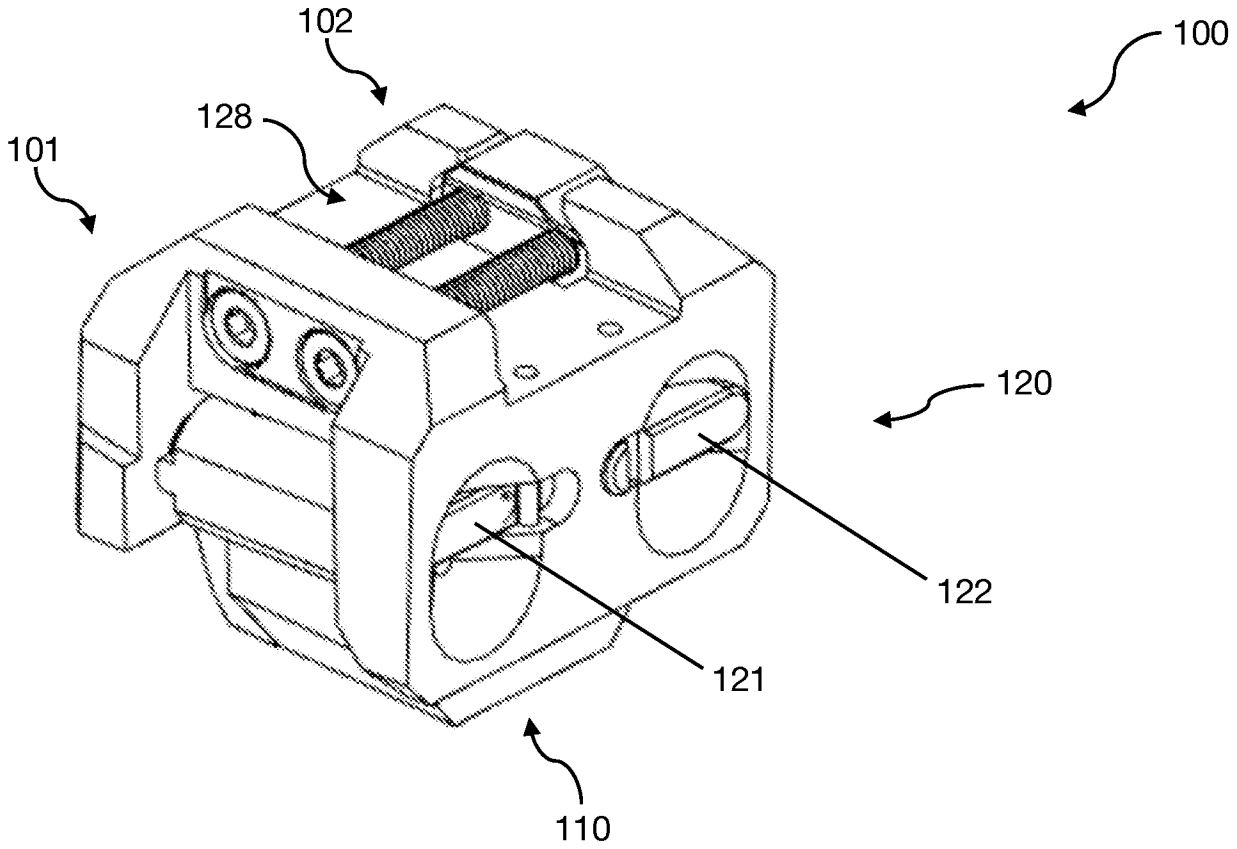
FIG. 1 is a schematic view of a stock-to-firearm adaptor on the first side in the present invention.
Figure 2:
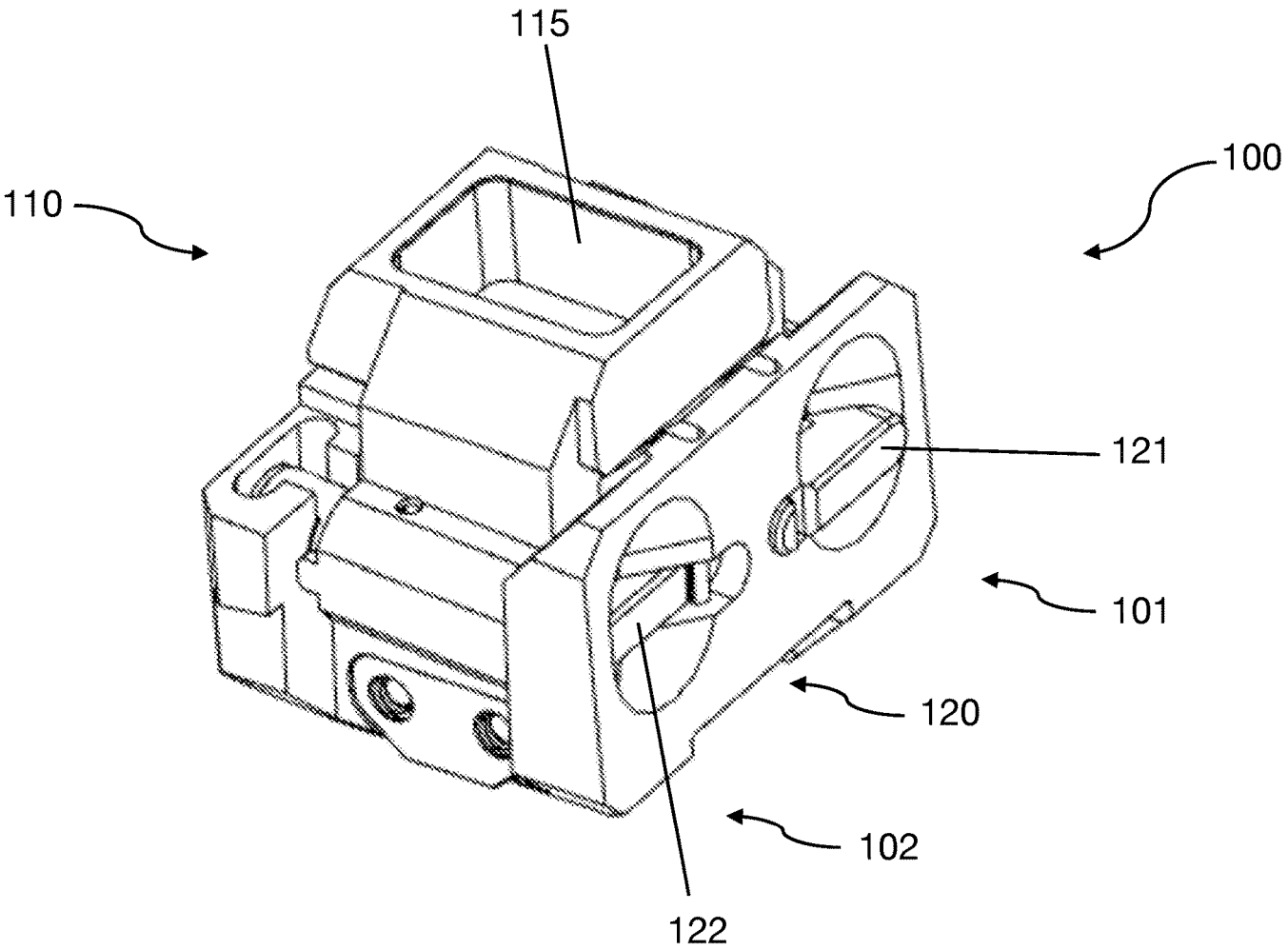
FIG. 2 is a schematic view of the stock-to-firearm adaptor from another view angle in the present invention.
Figure 11:
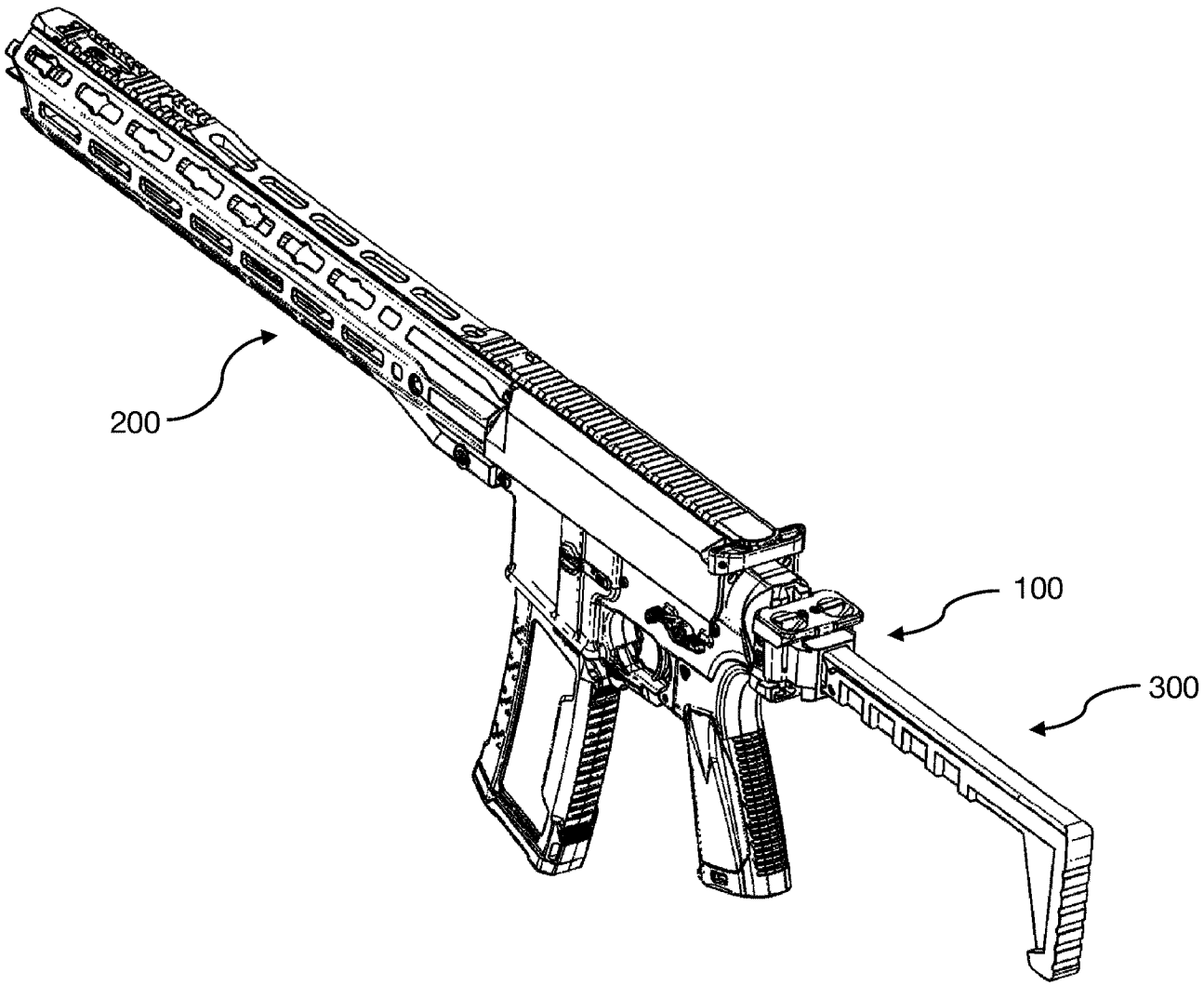
FIG. 11 is a schematic view of the stock-to-firearm adaptor as an interface to connect a firearm and a stock in the present invention.
Figure 12:
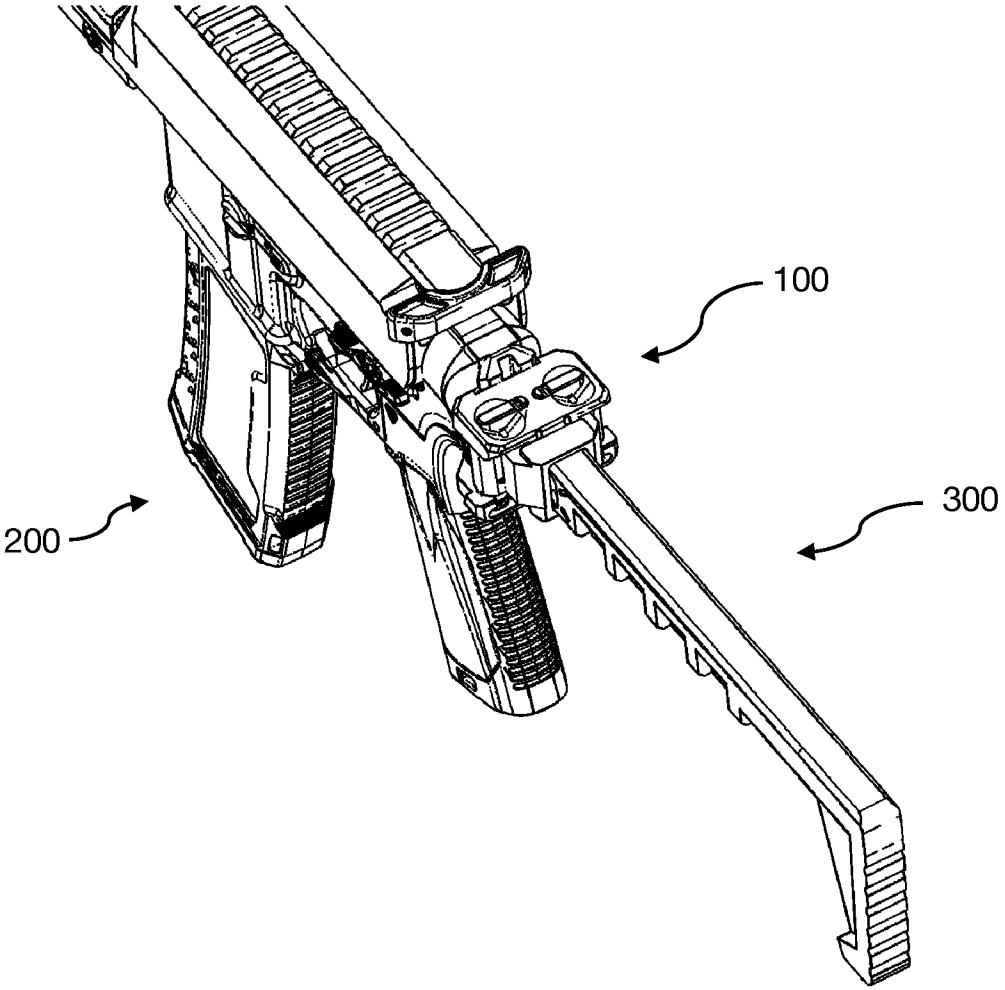
FIG. 12 is a partial enlarged view of the stock-to-firearm adaptor as an interface to connect a firearm and a stock in the present invention.

Referring to FIGS. 1 and 10, the stock-to-firearm adaptor 100 is configured to be an interface of the firearm and the stock. In one embodiment, the base 110 may include a stock receiving hole 115 to receive a stock 300, while the top portion 120 may include a firearm attaching assembly 128 to couple the top portion 120 to a firearm 200 as shown in FIGS. 11 and 12.

Figure 13:
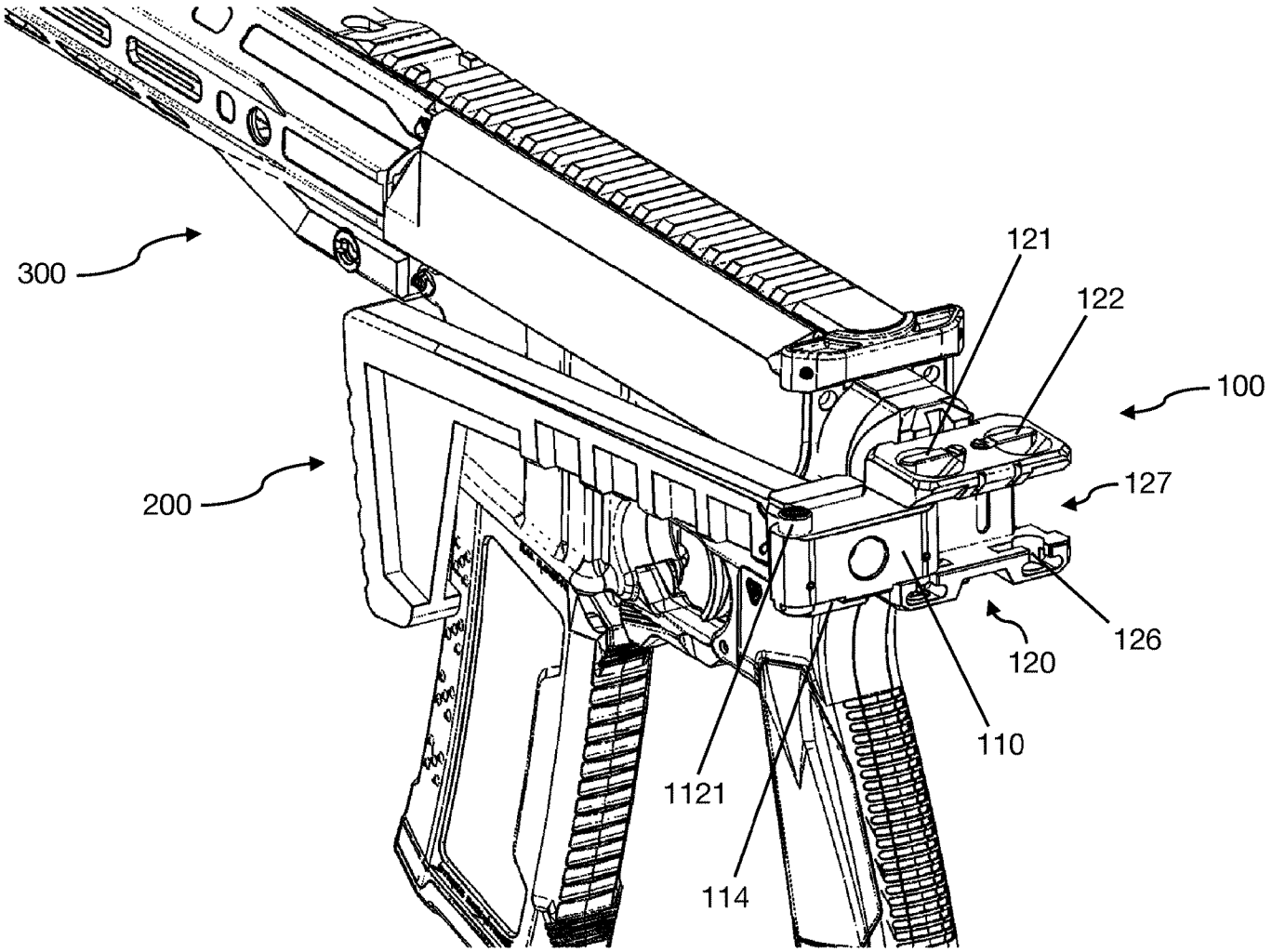
FIG. 13 is a schematic view of the stock-to-firearm adaptor to enable the stock to rotate to one side of the firearm.

As discussed above, by pressing either the first button 121 or the second button 122, the top portion 120 can rotate through the pivotal connection between the top portion 120 and the base 110 on the second side 102 and the first side 101, respectively. In other words, if the top portion 120 is fixed, the base 110 can also rotate through the pivotal connection between the top portion 120 and the base 110. In one embodiment, as shown in FIG. 13, the adaptor 100 is fixed to the firearm 200 through the firearm attaching assembly 128 and user can press the second button 122 to disengage the second engaging unit 112 from the second side grooves 126, so the base 110 along with the stock 300 can be rotated in a clockwise manner to one side of the firearm 200. In one embodiment, when the base 110 with the stock 300 rotates 180 degrees, the position securing unit 114 pops out to lock the base 110 with the stock 300 to the fully extended position on one side of the firearm 200. Namely, the stock 300 is in a first folded configuration when the base 110 is rotated to the fully extended position on one side of the firearm 200. It is noted that the position securing unit 114 can be pressed to disengage with the outer edge 125, and the base 110 can be rotated back to the top portion 120 in a counter-clockwise manner to the closed configuration to simultaneously bring the stock 300 back to its normal position that is ready for the user to shoot.

Figure 14:
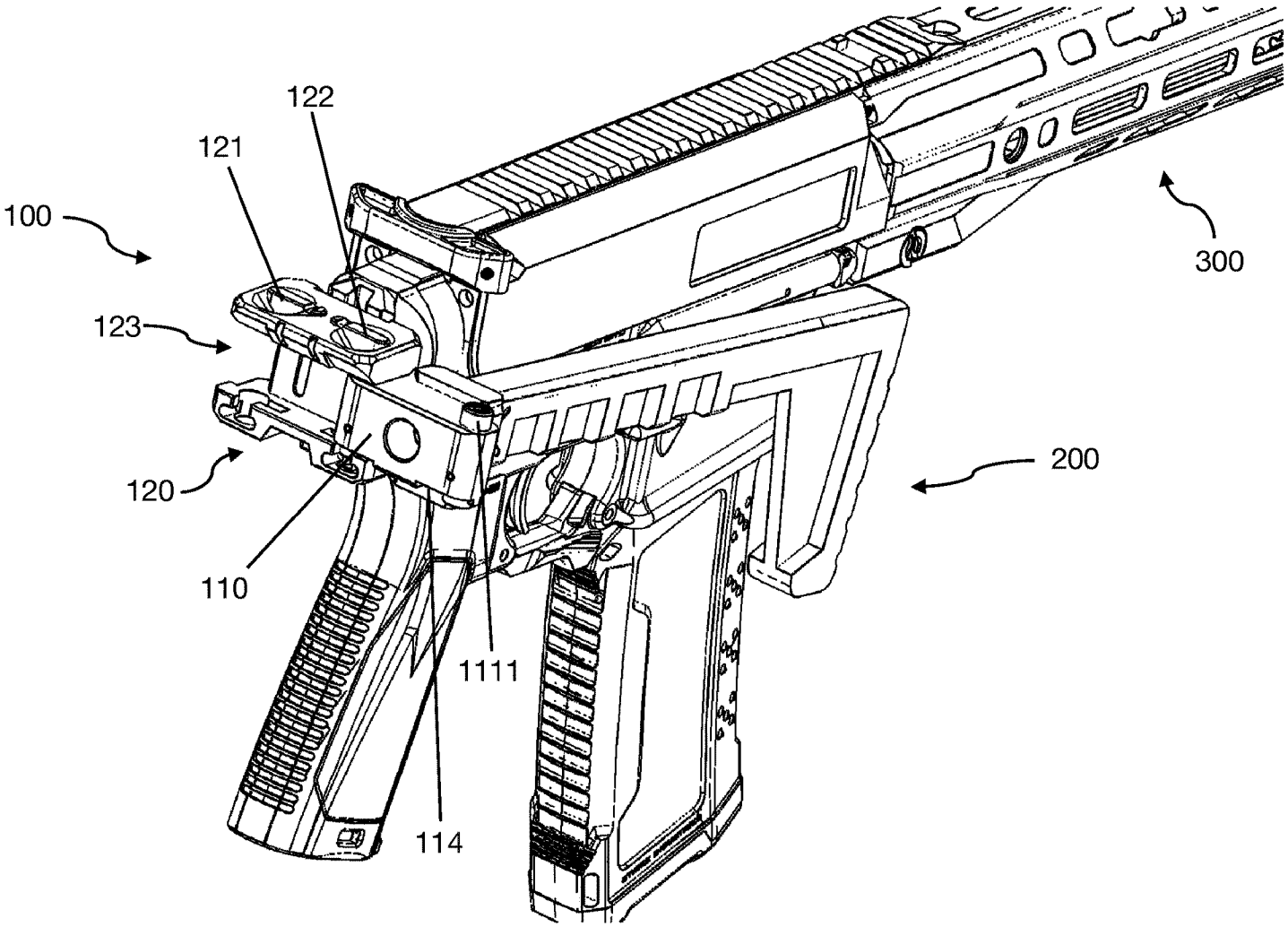
FIG. 14 is a schematic view of the stock-to-firearm adaptor to enable the stock to rotate to another side of the firearm.

Likewise, as shown in FIG. 14, the user can press the first button 121 to disengage the first engaging unit 111 from the first side grooves 124, so the base 110 along with the stock 300 can be rotated in a counter-clockwise manner to the other side of the firearm 200. In one embodiment, when the base 110 with the stock 300 rotates 180 degrees, the position securing unit 114 pops out to lock the base 110 with the stock 300 to the fully extended position on the other side of the firearm 200. Namely, the stock 300 is in a second folded configuration when the base 110 is rotated to the fully extended position on the other side of the firearm 200. It is noted that the position securing unit 114 can be pressed to disengage with the outer edge 125, and the base 110 can be rotated back to the top portion 120 in a clockwise manner to the closed configuration to simultaneously bring the stock 300 back to its normal position that is ready for the user to shoot.

Having described the invention by the description and illustrations above, it should be understood that these are exemplary of the invention and are not to be considered as limiting. Accordingly, the invention is not to be considered as limited by the foregoing description, but includes any equivalent.

What is claimed is:

1. A foldable stock for a firearm comprising an adaptor configured to connect the firearm and the stock, said adaptor having a base and a top portion that are pivotally connected, and the top portion of the adaptor attached to the firearm while the base of the adaptor connected to the stock, wherein the base has a first engaging unit located at a first side, a second engaging unit located at a second side, and a first button and a second button that are resiliently connected with the top portion on the first side and the second side respectively; the top portion includes a pair of first side grooves and a pair of second side grooves configured to engage with the first engaging unit and the second engaging unit respectively, wherein when the first button is pressed, the first engaging unit of the base can be disengaged with the first side grooves of the top portion while the second engaging unit is pivotally engaging with the second side grooves, and the base with the stock can be detached from the top portion that is attached with the firearm to rotate toward one side of the firearm, and wherein when the second button is pressed, the second engaging unit of the base can be disengaged with the second side grooves of the top portion while the first engaging unit is pivotally engaging with the first side grooves, and the base with the stock can be detached from the top portion that is attached with the firearm to rotate toward the second side of the firearm.

2. The foldable stock for the firearm of claim 1, wherein the first engaging unit is formed and resiliently connected to one side of the top protruding portion of the base, and the first engaging unit has a resilient end and a fixed end; the second engaging unit is formed and resiliently connected to the other side of the top protruding portion of the base, and the second engaging unit has a resilient end and a fixed end.

3. The foldable stock for the firearm of claim 2, wherein a pair of first side grooves are formed on each side of an inner sidewall of the top portion on the first side, and each of the first side grooves is configured to receive and secure the resilient end and fixed end of the first engaging unit respectively when the top portion engages with the base in a fully closed configuration of the stock-to-firearm adaptor.

4. The foldable stock for the firearm of claim 2, wherein a pair of second side grooves are formed on each side of an inner sidewall of the top portion on the second side, and each of the second side grooves is configured to receive and secure the resilient end and fixed end of the second engaging unit respectively when the top portion engages with the base in a fully closed configuration of the stock-to-firearm adaptor.

5. The foldable stock for the firearm of claim 3, wherein the first button is configured to communicatively contact with the resilient end of the first engaging unit, and when the first button is pressed, the resilient end of the first engaging unit is also pressed to retract and can be disengaged from one of the first side grooves, and the top portion can be simultaneously lifted up to disengage the fixed end of the first engaging unit from the other first side groove, so the entire top portion can be lifted away from the base on the first side, and rotates at most 180 degrees through a pivotal connection between the top portion and the base on the second side.

6. The foldable stock for the firearm of claim 4, wherein the second button is configured to communicatively contact with the resilient end of the second engaging unit, and when the second button is pressed, the resilient end of the first engaging unit is also pressed to retract and can be disengaged from one of the second side grooves, and the top portion can be simultaneously lifted up to disengage the fixed end of the second engaging unit from the other second side groove, so the entire top portion can be lifted away from the base on the second side, and rotates at most 180 degrees through a pivotal connection between the top portion and the base on the first side.

7. The foldable stock for the firearm of claim 1, wherein the top portion includes a firearm attaching assembly to couple the top portion to the firearm.

8. The foldable stock for the firearm of claim 1, wherein the base includes a stock receiving hole to receive the stock.

9. The foldable stock for the firearm of claim 1, the base further includes a position securing unit which is resiliently connected to an inner sidewall of the base and located between the inner sidewall of the base and the corresponding side an inner sidewall of the top portion; and when the top portion is engaged with the base, the position securing unit is completely pressed into the inner sidewall of the base to form a portion of the inner sidewall thereof.

10. The foldable stock for the firearm of claim 9, wherein when the top portion is lifted and extends by rotating away from either the first side or the second side, the portion of the position securing unit pops out from the inner sidewall of the base because of the resilient force, and the position securing unit is configured to completely pop out to secure the top portion and the base in a linear configuration.

11. The foldable stock for the firearm of claim 9, wherein the top portion includes an outer edge to block the position securing unit from further movement.

* * * * *